US006767313B2

(12) United States Patent
Sayce

(10) Patent No.: US 6,767,313 B2
(45) Date of Patent: Jul. 27, 2004

(54) PARALLEL SKI TRAINING DEVICE

(76) Inventor: Robert A. Sayce, 17 High St., Wiscasset, ME (US) 04578

( * ) Notice: Subject to any disclaimer, the term of this patent is extended or adjusted under 35 U.S.C. 154(b) by 166 days.

(21) Appl. No.: 09/961,657

(22) Filed: Sep. 24, 2001

(65) Prior Publication Data

US 2003/0060338 A1 Mar. 27, 2003

(51) Int. Cl.[7] ..... A63B 69/18; A63B 22/00
(52) U.S. Cl. ..... 482/71; 482/70; 482/146
(58) Field of Search ..... 482/70–71, 146–147, 482/51–53; 434/253; 280/842

(56) References Cited

U.S. PATENT DOCUMENTS 3,650,528 A * 3/1972 Natterer ..... 482/71
4,376,532 A * 3/1983 Hunstad ..... 482/71
4,739,986 A * 4/1988 Kucharik et al. ..... 482/79
5,242,340 A * 9/1993 Jerome ..... 482/52
5,453,065 A * 9/1995 Lien et al. ..... 482/52
5,643,164 A * 7/1997 Teff ..... 482/146
5,645,512 A * 7/1997 Yu ..... 482/53
5,730,690 A * 3/1998 Guidry ..... 482/146
5,800,313 A * 9/1998 Yu ..... 482/53
5,813,958 A * 9/1998 Tomita ..... 482/146
5,879,276 A * 3/1999 Miller ..... 482/146
5,897,464 A * 4/1999 Mcleod ..... 482/79
6,428,451 B1 * 8/2002 Hall ..... 482/146
6,461,280 B1 * 10/2002 Benedikter ..... 482/74

* cited by examiner

*Primary Examiner*—Jerome W. Donnelly
*Assistant Examiner*—Fenn C. Mathew
(74) *Attorney, Agent, or Firm*—Charles F. Seyboldt

(57) ABSTRACT

A parallel ski training or exercise apparatus is described. The ski training device provides the combination of parallel motion, edging, and weight shifting that characterizes downhill parallel skiing. Two foot platforms are mounted on a base, on independent rotation axes centered about the balls of the user's feet. The foot platforms are constrained to rotate together, i.e. their longitudinal axes remain parallel. The foot platforms can tilt from side to side to simulate the edging motion of downhill parallel skiing. Varying amounts of resistance to rotation and to tilting can be obtained by changing the springs or other devices that bias the foot platforms to straight-ahead and level alignment. The base of the parallel ski training device can be tilted to an angle by a support having a circular arc or hemispherical shape. With the front of the base raised, the user's ankles assume the leaning forward attitude that is used in parallel skiing. Rocking of the base from side to side simulates the change in attitude that occurs as a skier changes direction on a downhill slope.

15 Claims, 7 Drawing Sheets

PARALLEL SKI TRAINING DEVICE

BACKGROUND OF THE PRESENT INVENTION

1. Summary of the Prior Art

This invention relates to a training device, and more particularly to a parallel ski training device for conditioning and developing the muscles, balance and reflexes used in parallel skiing.

The parallel ski training device of the present invention has two foot platforms, each of which rotates about its own independent vertical axis, where the rotation angles of the two foot platforms are always congruent.

The ski training device of the present invention can be adapted so the foot platforms can independently tilt, to simulate "edging." Whereas the two foot platforms are mounted to a base platform, further adaptations are to tilt the base platform and/or permit it to rotate about a near-horizontal axis. These adaptations simulate the forces caused by skiing at lateral downhill angles.

Exercise devices for parallel ski training are well known, and appear in a variety of embodiments. Various ski instruction and training devices have been proposed, having two foot platforms and where the two foot platforms have independent vertical rotation axes.

U.S. Pat. No. 3,834,693, to Poppenberger describes such a ski instruction apparatus; but the rotation angles of the two foot platforms are completely independent, and are not kept congruent.

U.S. Pat. No. 4,376,532 to Hunstad also describes an apparatus having two foot platforms, and includes a spring means that urges, but does not force, the two foot platforms to rotate in parallel. At column 2, lines 54 to 67 of Hunstad, the inventor describes the foot platforms as rotating in parallel relationship, and also describes a means for varying the resistance to rotating in non-parallel relationship by locating extension springs (24) at various positions on the foot platforms.

Other ski instruction devices have been proposed, also having two foot platforms, but where the foot platforms do not have independent vertical axes.

U.S. Pat. No. 4,429,869, to Eckstein describes an apparatus having two foot platforms, where both are mounted to a common platform, and the common platform has one vertical axis of rotation. At column 4, lines 20 to 33, the inventor notes that the foot platforms are kept parallel to each other. But the foot platform rotation of the present invention, being about two vertical axes, causes a training motion that is distinguishable from the training motion of Eckstein, which is about a single vertical axis.

U.S. Pat. No. 4,880,226 to Krantz describes another variation of the two foot platform style of exercise or training apparatus, but as with Eckstein, the rotation of the foot platforms about a near-vertical axis will occur about a single axis, common to both foot platforms. At column 3, lines 31 to 38, the inventor describes rotation of the sole plates about longitudinal axes; which simulates the edging motion noted above. In the skiing simulator of Eckstein, the edging angles of the two foot platforms are forced to be congruent.

Yet another variation of exercise device provides for a single foot platform, rather that two.

U.S. Pat. No. 4,787,630, to Watson et al.; U.S. Pat. No. 4,946,160 to Bertoletti; U.S. Pat. No. 4,953,858 to Zelli; U.S. Pat. No. 5,399,140 to Klippel; U.S. Pat. No. 5,545,115 to Corcoran; U.S. Pat. No. 5,643,164 to Teff; United Kingdom Patent Specification 1,372,342 to Simpson; UK Patent Application 2,004,190A of Dehan; and European Patent Specification 0,088,643 of Lie each describe a variation of exercise or training apparatus having a single foot platform.

2. Summary of the Present Invention

The parallel ski training device of the present invention accurately simulates the motions and forces of parallel skiing. It can be used by individuals of all sizes and ages. It can be used to teach the novice or condition the expert.

The use of the parallel ski training device of the present invention does not require the wearing of ski boots, or the use of ski bindings or other special equipment.

The distinguishing characteristic of the present invention over the prior art is the combination of independent rotation axes on two foot supports, in combination with mandatory parallel rotation of the foot supports.

The present invention can be adapted to further include tilting motions on each foot platform to simulates "edging." The rotation and tilting motions can be biased to straight-ahead and level positions.

An additional adaptation is the raising of the front edge of the base platform. This causes the user's ankles, knees, legs and body to adopt the same attitude that is adopted when leaning forward during downhill skiing activity.

Yet another adaptation of the present invention is to arrange the base platform in such a way that it can rock from right to left.

The adaptations listed above can be combined in various ways, i.e. a parallel ski training device of the present invention can be made with any combination of: independent rotation axes having mandatory parallel rotation; foot platform tilting; biasing of rotation to straight ahead; biasing of tilting to level; raising of the front edge of the base platform; and rocking of the base platform.

The present invention relates to a parallel ski training device that may be adapted to use various materials and methods of construction while providing the essential features. Specific features of the invention will be apparent from the above and from the following description of the illustrative embodiments when considered with the attached drawings and the appended claims.

In summary, and in accordance with the above discussion, the foregoing objectives are achieved in the following embodiments.

1. An exercise apparatus comprising:

a base platform having a bottom surface and a flat top face, front and rear edges, left and right edges, and a longitudinal centerline equidistant from the left and right edges;

first and second rotation members having top faces and longitudinal axes and, where the rotation members are rotatably mounted to the top face of the base platform; and means to constrain the rotation of the rotation members so that their longitudinal axes always remain parallel.

2. An exercise apparatus as described in paragraph 1, further comprising:

first and second foot platforms tiltably mounted to the first and second rotation member top faces respectively, where the foot platform tilt axes and the rotation member longitudinal axes are parallel.

3. An exercise apparatus as described in paragraph 2, where the foot platform tilt axes are located between the rotation member top faces and the foot platforms.

4. An exercise apparatus as described in paragraph 1, further comprising means to bias the rotation members rotation angle to the position where the line connecting the two rotation axes is perpendicular to the rotation members longitudinal axes.

5. An exercise apparatus as described in paragraph 1, where the means to constrain the rotation of the rotation members comprises a tie bar having a longitudinal axis and where the tie bar is rotatably fastened to both rotation members.

6. An exercise apparatus as described in paragraph 1, where the means to constrain the rotation of the rotation members comprises:

a first gear or friction wheel fastened to the first rotation member and having a centerline that is coaxial with the first rotation member rotation axis;

a second gear or friction wheel fastened to the second rotation member and having a centerline that is coaxial with the second rotation member rotation axis; and an idler gear or idler gear train or friction wheel or friction wheel train or toothed belt or belt arranged in communication with both first and second gear or friction wheel, so that both first and second gear or friction wheel rotate in unison.

7. An exercise apparatus as described in paragraph 5, further comprising:

first and second foot platforms tiltably mounted to first and second rotation member top faces respectively, where the foot platform tilt axes and the rotation member longitudinal axes are parallel.

8. An exercise apparatus as described in paragraph 7, further comprising means to bias each foot platform tilt angle to the position where the top face of the foot platform is parallel to the top face of the base platform.

9. An exercise apparatus as described in paragraph 1, where the base platform rear edge is curved; and further comprising:

a pedestal having a hemispherical or circular arc or semi-conical or semi-round shape; and where the pedestal is located on the base platform bottom surface, on the base platform longitudinal centerline, closer to the base platform front edge than to its rear edge, so that the front edge of the base platform is raised and the base platform is rockable from right to left.

10. An exercise apparatus as described in paragraph 1, wherein the bottom surface of the base platform is shaped so that the front edge of the base platform is raised and the base platform is rockable from right to left.

11. An exercise apparatus as described in paragraph 9, further comprising:

first and second foot platforms tiltably mounted to first and second rotation member top faces respectively, where the foot platform tilt axes and the rotation member longitudinal axes are parallel.

12. An exercise apparatus as described in paragraph 11, where the foot platform tilt axes are located between the rotation member top faces and the foot platforms.

13. An exercise apparatus as described in paragraph 9, further comprising means to bias the rotation members rotation angle to the position where one line can be perpendicular to both rotation members longitudinal axes.

14. An exercise apparatus as described in paragraph 9, where the means to constrain the rotation of the rotation members comprises a tie bar having a longitudinal axis and where the tie bar is rotatably fastened to both rotation members.

15. An exercise apparatus as described in paragraph 14, further comprising:

first and second foot platforms tiltably mounted to first and second rotation member top faces respectively, where the foot platform tilt axes and the rotation member longitudinal axes are parallel.

16. An exercise apparatus as described in paragraph 15, further comprising means to bias each foot platform tilt angle to the position where the top face of the foot platform is parallel to the top face of the base platform.

17. An exercise apparatus as described in paragraph 3, further comprising compression springs interposed between the top faces of the rotation members and bottom faces of the foot platforms so as to bias each foot platform tilt angle to the position where the top face of the foot platform is parallel to the top face of the base platform.

18. An exercise apparatus as described in paragraph 4, where the means to bias the rotation angle comprises extension springs.

19. An exercise apparatus as described in paragraph 5, further comprising:

first and second foot platforms tiltably mounted to the first and second rotation member top faces respectively;

foot platform tilt axes, each comprising eyes fastened to the bottom face of a foot platform, eyes fastened to the top face of a rotation member, and a shaft passing through all of the eyes so that the longitudinal axes of the shafts are parallel with the longitudinal axes of the rotation members;

compression springs interposed between the top faces of the rotation members and bottom faces of the foot platforms so as to bias each foot platform tilt angle to the position where the top face of the foot platform is parallel to the top face of the base platform;

extension springs arranged to bias the rotation members rotation angle to the position where the line connecting the two rotation axes is perpendicular to the rotation member longitudinal axes; and a pedestal having a hemispherical or circular arc or semi-conical or semi-round shape, where the pedestal is located on the base platform bottom surface, on the base platform longitudinal centerline, closer to the base platform front edge than to its rear edge, so that the front edge of the base platform is raised and the base platform is rockable from right to left.

20. An exercise apparatus as described in paragraph 19, where the rotation member rotation axes are located proximately below the balls of the user's feet and further comprising:

rotation member support means located between the rotation member bottom faces and the base platform top face, and located proximately below the heels of the user's feet.

DESCRIPTION OF THE PREFERRED EMBODIMENTS OF THE PRESENT INVENTION

Figure 1:
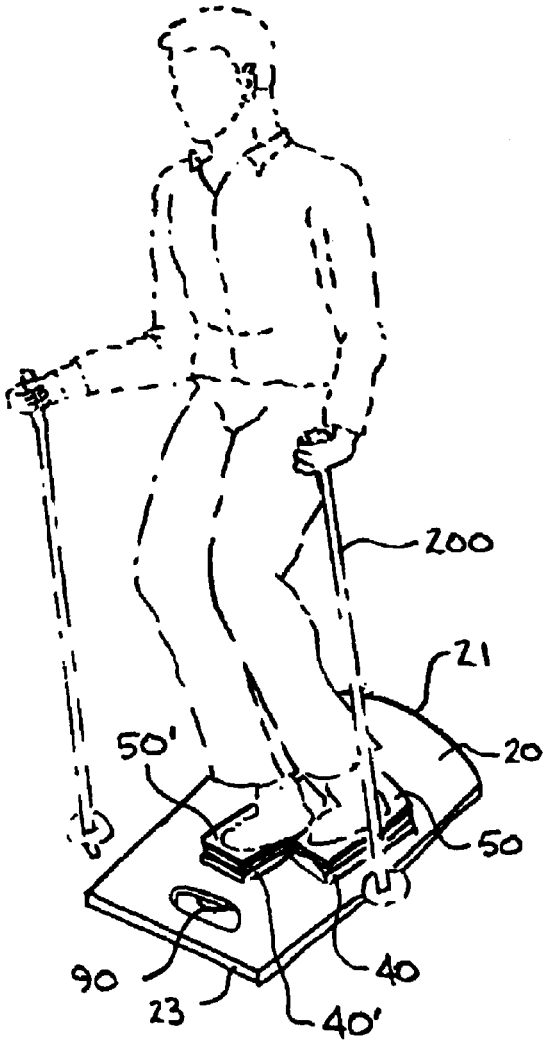
FIG. 1 is a perspective view showing a person using the parallel ski training device.

FIG. 1 is a perspective view showing a person using the parallel ski training device.

A parallel ski training device according to the present invention is preferably practiced by standing on tiltable foot platforms (50–50') which are mounted to rotation members (40–40'), which are in turn rotatably mounted to base platform (20). The user does not need to wear any special footwear, i.e. the use of street shoes or tennis-style shoes is suitable. In order to maintain balance and simulate the experience of downhill skiing, it is recommended that the user carry ski poles (200) having rubber tips.

The front edge (23) of base platform (20) can be slightly elevated by the use of pedestal support (90) (partially hidden). The combination of curved pedestal support (90) and curved rear edge (21) of base platform (20) permits base platform (20) to rock from right to left.

The tilting motion of foot platforms (50–50') is also from right to left, and simulates the motion that is termed "edging" by downhill skiers. Various constructions, discussed below, can be provided to permit the edging motion.

In the preferred embodiment, the centers of rotation of rotation members (40–40') are located approximately under the balls of the user's feet. It is an essential feature of the present invention that both rotation members (40–40') rotate "in unison," that is, so that their longitudinal axes are forced to always be parallel.

The combination of right to left tilting, or edging, of foot platforms (50–50'), the rotation of rotation members (40–40'), the raised front edge (23) and right to left rocking of base platform (20) mimics the motion and body attitude of downhill skiing. The user can train the leg, ankle and foot muscles, as well as the waist and upper body, to move in a coordinated fashion that enhances the downhill skiing experience.

Figure 2:
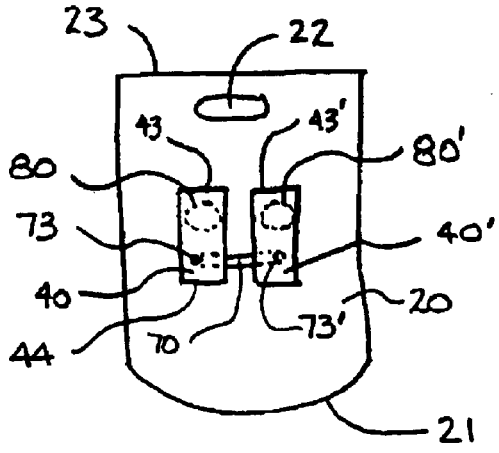
FIG. 2 is a plan view of the parallel ski training device with the rotation members directed "straight ahead".

FIG. 2 is a plan view of the parallel ski training device with the rotation members directed "straight ahead".

Base platform (20) can be made from plywood, fiberglass, plastic laminate, metal, or any material that provides sufficient rigidity and strength to support the weight and dynamics of the skiing exercise. A handling hole (22) can be provided in base platform (20) in order to facilitate the easy moving of the parallel ski training device from one location to another.

Rotation members (40–40') are rotatably mounted to base platform (20), and can be rotatably mounted using thrust bearings (80–80'). The center of rotation of each thrust bearing (80–80') is preferably, but not necessarily, located approximately where the ball of the user's foot will be. The distance between the centers of rotation of the rotation members is preferably about 150 millimeters (6 inches). Rotation members (40–40') are preferably about 110 millimeters (4¼ inches) wide by about 300 millimeters (12 inches) long, and are preferably mounted so that the front edges (43–43') of the rotation members (40–40')are about 80 millimeters (3¼ inches) from the center of thrust bearings (80–80').

Rotation members (40–40') can be forced to rotate in unison with the use of a tie bar (70). In the preferred embodiment, the centers of rotation (73–73') at the ends of tie bar (70) are located about 150 millimeters (6 inches) from each other, and on the longitudinal axes of the rotation members, and also about 150 millimeters (6 inches) from the centers of rotation of thrust bearings (80–80'). This arrangement produces a four-bar mechanism that is constrained to rhombic shapes, i.e. square and other rhombi.

The tie-bar centers of rotation (73–73') can be equipped with anti-friction (ball) bearings, or with permanently lubricated journal bearings, or with any type of bearing that is suitable for the service (not illustrated).

Figure 3:
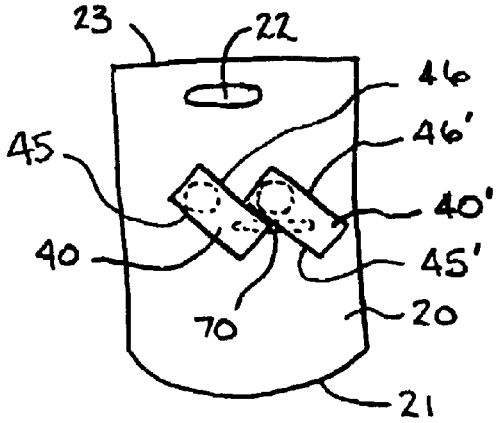
FIG. 3 is a plan view of the parallel ski training device with the rotation members fully rotated counterclockwise.

FIG. 3 is a plan view of the parallel ski training device with the rotation members fully rotated counter-clockwise.

One feature of the present invention is that the rotation members (40–40') are forced to rotate so that their longitudinal axes are always parallel. But, the amount of rotation can be limited. At the full extent of counter-clockwise rotation, right-hand edge (46) of left-hand rotation member (40) comes in contact with the left hand edge (45') of right-hand rotation member (40'). Using the proportions described above, the maximum amount of rotation of the rotation members (40–40') is from about 45 degrees counter-clockwise to about 45 degrees clockwise.

Figure 4:
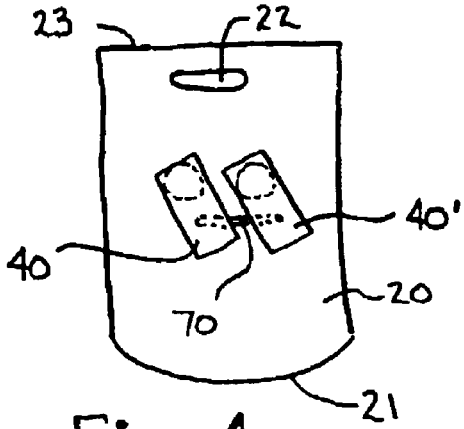
FIG. 4 is a plan view of the parallel ski training device with the rotation members partially rotated counterclockwise.

FIG. 4 is a plan view of the parallel ski training device with the rotation members partially rotated counter-clockwise.

No matter the amount of rotation of rotation members (40–40'), their longitudinal axes always remain parallel. The proportions of a parallel ski training device according to the present invention are preferably such that reaching maximum rotation does not occur during use.

Figure 5:
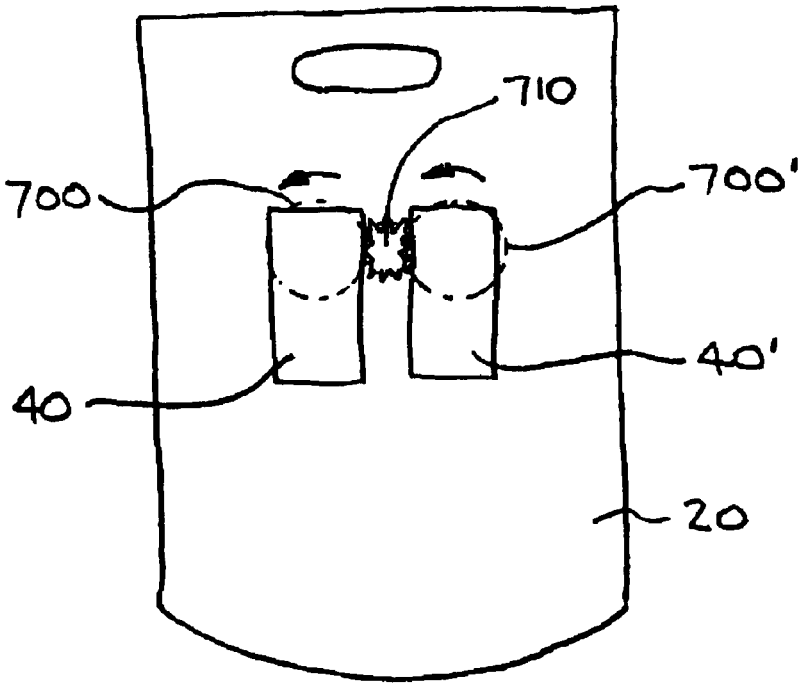
FIG. 5 is a plan view of the parallel ski training device with a gear train mechanism.

FIG. 5 is a plan view of the parallel ski training device with a gear train mechanism.

The practice of the present invention does not depend on a the use of a tie bar. Other mechanisms are contemplated to be in the scope of the present invention.

For example, spur gears (700–700'), each having the same pitch and same number of teeth, can be attached to rotation members (40–40') respectively. Rotation members (40–40') as well as spur gears (700–700') are mounted to bearings (not shown) at a fixed center distance on base platform (20). An idler gear (710), disposed between spur gears (700–700') forces the spur gears to rotate in unison.

Instead of spur gears, friction wheels of appropriate materials and size could be used in a similar fashion.

Figure 6:
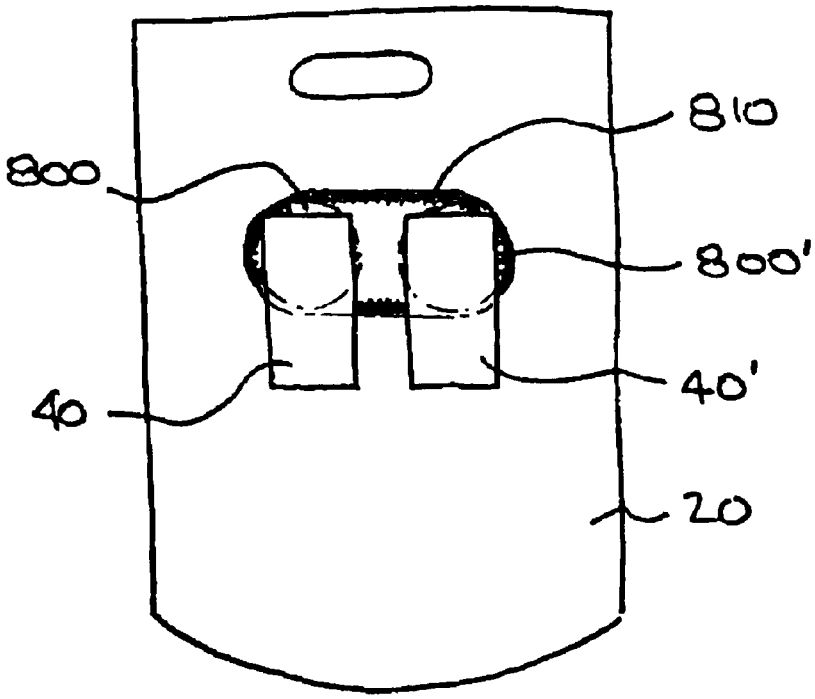
FIG. 6 is a plan view of the parallel ski training device with a toothed belt mechanism.

FIG. 6 is a plan view of the parallel ski training device with a toothed belt mechanism.

Or, toothed sprockets (800–800'), each having the same pitch and same number of teeth, can be attached to rotation members (40–40') respectively. Rotation members (40–40') as well as toothed sprockets (800–800') are mounted to bearings (not shown) at a fixed center distance on base platform (20). A toothed belt (810) runs between toothed sprockets (800–800') and forces the toothed sprockets to rotate in unison.

Instead of toothed sprockets, vee-belts or flat belts (with or without a tensioning idler) and matching pulleys could be used in a similar fashion.

Figure 7:
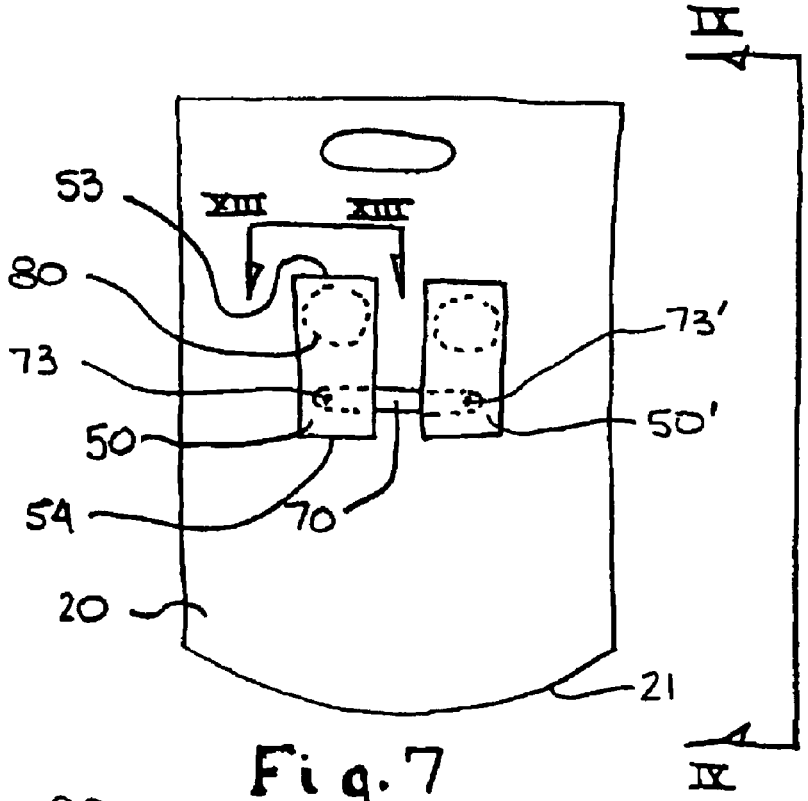
FIG. 7 is a plan view of the parallel ski training device with a tie bar mechanism.

FIG. 7 is a plan view of the parallel ski training device with a tie bar mechanism.

Figure 8A:
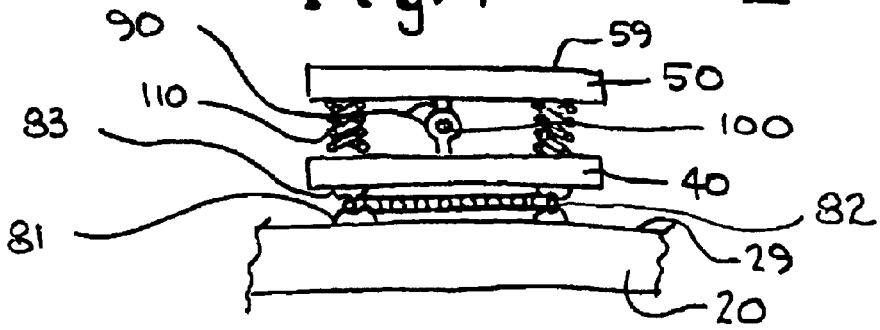
FIG. 8*a* is an elevation view taken in the direction of arrows "XIII" in FIG. 7.

FIG. 8*a* is an elevation view taken in the direction of arrows "XIII" in FIG. 7.

Anti-friction thrust bearing (80) is made of lower race (81), which is fastened to base platform (20), upper race (83) which is fastened to rotation member (40), and a series of rolling balls (82) disposed between lower race (81) and upper race (83). The type of thrust bearing commonly available in a hardware store, e.g. for construction of a lazy-susan, is suitable.

Foot platforms (50–50') and rotation members (40–40') can be made of plywood, wood, fiberglass, metal or other materials of suitable rigidity and strength to support the weight and dynamics of the ski training exercise.

Foot platform (50) is tiltably mounted to rotation member (40). FIG. 8*a* shows an end view of the tilt axis, where tilting occurs about steel shaft (100). Shaft (100) passes through a series of four steel eyes (90). Two eyes (90) are mounted to rotation member (40), one eye being located toward front edge (43) and the other toward the rear edge (44) (see FIG. 2), and are arranged so that shaft (100) can pass through both eyes.

Similarly, two eyes (90) are mounted to foot platform (50), one eye being located toward front edge (53) and the other toward the rear edge (54) (see FIG. 7), and are also arranged so that shaft (100) can pass through both eyes.

Eyes (90) can have wood screw threads, or, preferably, have straight threads. A straight threaded eye (90) can be fastened to a rotation member (40) or to a foot platform (50) using a combination of plywood nut, washers and jam nuts; or a combination of only washers and nuts (not illustrated).

Figure 9:
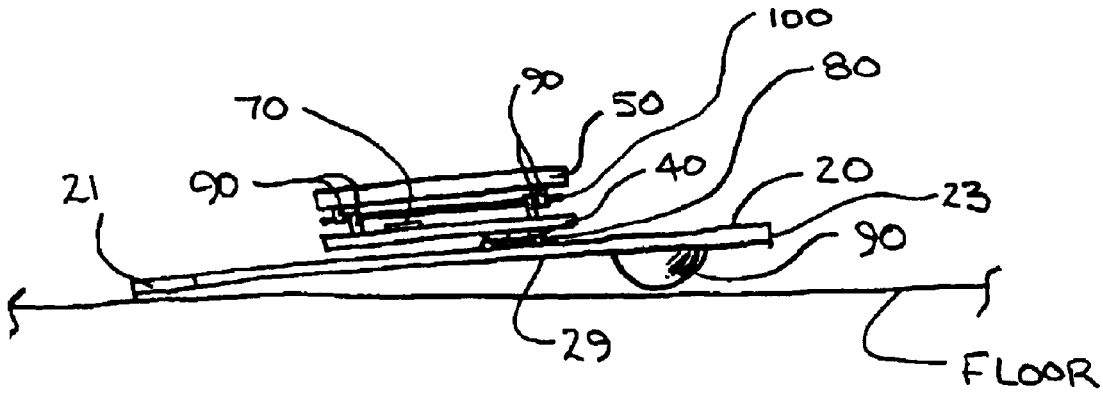
FIG. 9 is an elevation view taken in the direction of arrows "IX" in FIG. 7.

In one embodiment, the distance between the eyes in rotation member (40) is less than the distance between the eyes in foot platform (50), so that the foot platform (50) is not free to shift forward or back with respect to the rotation member (40). The four eyes (90) are aligned and shaft (100) is passed through all four. FIG. 9 illustrates this arrangement.

Various methods of providing a tilt axis between a rotation member (40) and a foot platform (50) are possible, such as pillow block bearings, ball and socket, journal bearings, anti-friction bearings, etc.

Compression springs (110) can be provided to bias is the tilting of foot platform (50) to the position where the top surface (59) of foot platform (50) is parallel with the top face (29) of base platform (20). In the preferred embodiment, four compression springs (110) are provided for each rotation member/foot platform assembly. Two compression springs (110) are located near the front edges (43–53) and two compression springs (110) are located near the rear edges (44–54) of each rotation member (40–40') and foot platform (50–50') respectively.

The preload and spring rate of the compression springs (110) can be varied to suit the user.

Figure 8B:
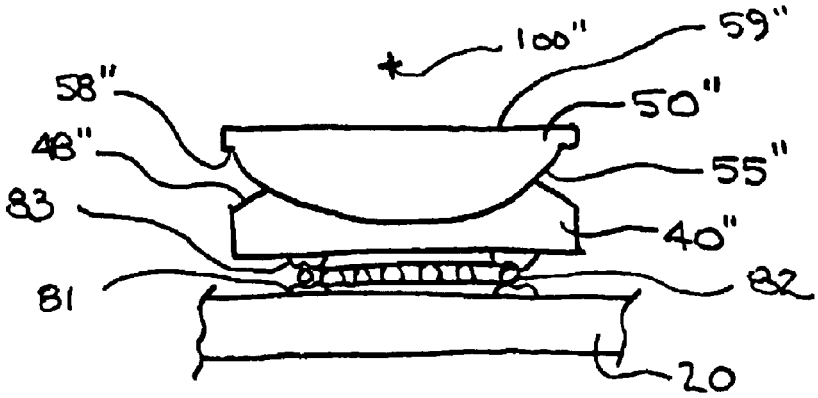
FIG. 8*b* is an elevation view taken in the direction of arrows "XIII" in FIG. 7.

FIG. 8*b* is an elevation view taken in the direction of arrows "XIII" in FIG. 7.

An alternative approach for providing foot platform tilting motion is illustrated in FIG. 8*b*. In this arrangement, the tilt axis (100") is located above the top surface (59") of foot platform (50"), rather than between the rotation member (40") and the foot platform (50").

Foot platform (50") is provided with a cylindrical convex lower surface (55"), and rotation member (40") is provided with a matching cylindrical concave upper surface. Tab faces (58") on foot platform (50") and stop faces (48") on rotation member (40") can be provided to limit the tilt angle to a predetermined maximum amount.

Figure 8C:
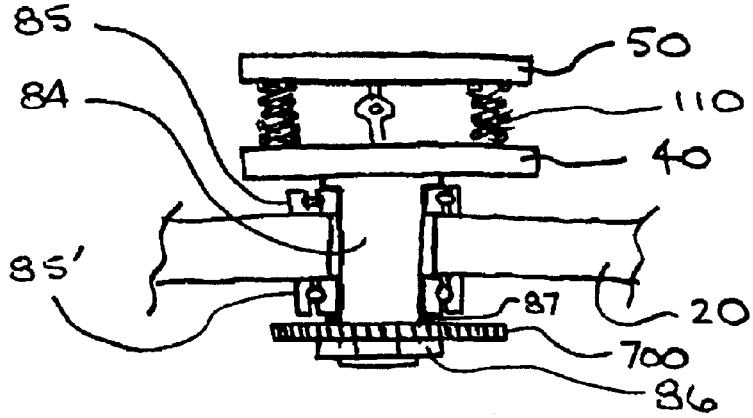
FIG. 8*c* is an elevation view taken in the direction of arrows "XIII" in FIG. 7.

FIG. 8*c* is an elevation view taken in the direction of arrows "XIII" in FIG. 7.

The present invention can be practiced using various arrangements for providing rotation axes. FIGS. 8*a* and 8*b* illustrate the use of anti-friction thrust bearings. FIG. 8*c* illustrates rotation member (40) mounted to a spindle shaft (84), and the spindle shaft running on anti-friction bearings (85–85').

Spacer (87) is used to hold spur gear (700) away from the outer race of bearing (85'), and nut (86) holds spindle shaft (84) in place. Spur gear (700) is not an essential part of providing spindle-style rotation axes, and is illustrated only to indicate the possibility of practicing the coordination of the rotation members using spur gears or toothed sprockets that are located on the underside of the base platform. Such an arrangement may prove advantageous as a means to isolate pinch points.

FIG. 9 is an elevation view taken in the direction of arrows "IX" in FIG. 7.

During the right and left turning that is common during downhill skiing, the skier's right foot will alternate between being on the uphill and downhill sides of the skier's left foot. During this transition, the skier is shifting weight from one foot to the other. This motion and weight-shifting can be mimicked by permitting the base platform to rock from right to left.

Also, raising the front edge (23) of base platform (20) causes the ankles to adopt a position that is similar to the forward lean that is appropriate for downhill skiing.

Front edge (23) of base platform (20) can be elevated using a pedestal (90). Rear edge (21) of base platform (20) can be curved, to permit the base platform to rock from side to side. In one embodiment, pedestal (90) is a hemisphere with a radius of about 38 millimeters (1½ inch), and is located on the longitudinal axis of base platform (20), about 215 millimeters (8½ inches) from the line connecting the rotation axes of thrust bearings (80), toward front edge (23).

Various arrangements for providing the raised front edge (23) and base platform rocking are possible within the scope of the present invention. For example, base platform (20) could be produced with a convex bottom surface; or pedestal (90) could have a semicircular or semi-conical shape (not illustrated).

Pedestal (90) of a parallel ski training device according to the present invention can be fastened to base platform (20), or it can be a separate piece that the skier can remove and replace without the use of tools. A depression or socket (or a variety of depressions and sockets) can be provided on the bottom surface (29) of base platform (20) to cause the pedestal to remain in place during use, and to permit the skier to choose from a range of elevation with only one pedestal.

Figure 10A:
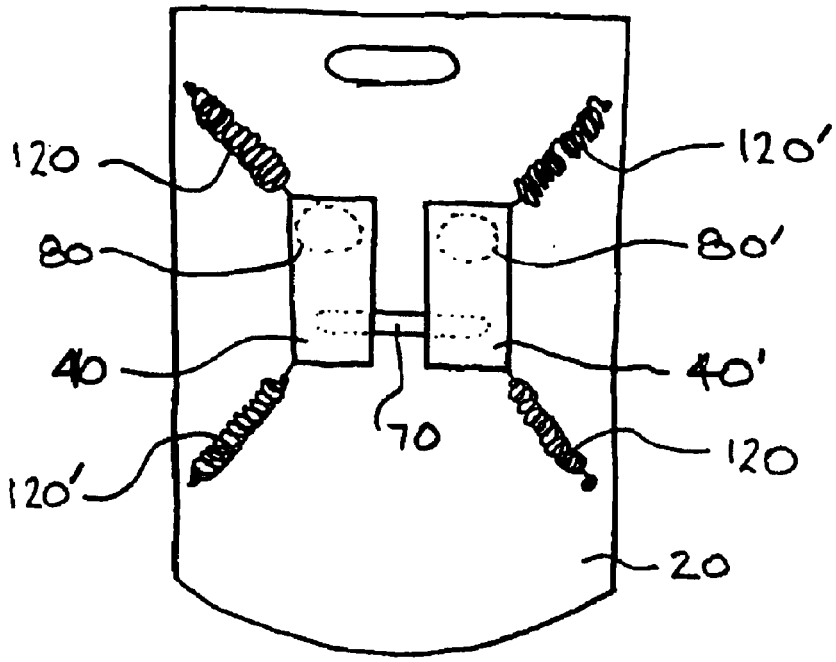
FIG. 10*a* is a plan view/diagram of the parallel ski training device showing an arrangement of rotation biasing extension springs.

FIG. 10*a* is a plan view/diagram of the parallel ski training device showing an arrangement of rotation biasing extension springs.

While rotation members (40–40') are free to assume various degrees of rotation, one embodiment of the present invention involves biasing the rotation members to the "straight ahead" orientation.

One means of biasing the rotation members (40–40') to the straight ahead orientation is via extension springs (120–120') that run from rotation members (40–40') to the base platform (20). As illustrated in FIG. 10*a*, when rotation members (40–40') rotate counter-clockwise, springs (120') will undergo extension, and springs (120) will be shortened or relaxed. The system is biased to return the rotation members (40–40') to the straight-ahead orientation, unless an external force holds it elsewhere.

Although FIG. 10*a* shows the use of four springs, the biasing function can be performed using fewer or more than this number.

Figure 10B:
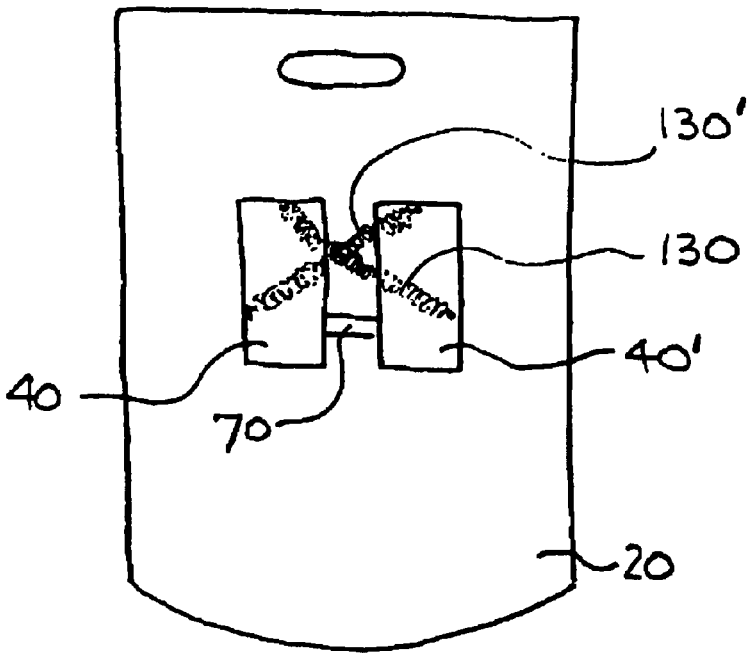
FIG. 10*b* is a plan view/diagram of the parallel ski training device showing another arrangement of rotation biasing extension springs.

FIG. 10*b* is a plan view/diagram of the parallel ski training device showing another arrangement of rotation biasing extension springs.

Another means of biasing the rotation members (40–40') to the straight ahead orientation is via extension springs (130–130') that run "crosswise" between rotation members (40–40'). As illustrated in FIG. 10*b*, when rotation members (40–40') rotate counter-clockwise, spring (130) will undergo extension, and spring (130') will be shortened or relaxed.

The extension springs in either of these illustrations can be bungee-type cord, or elastic, or wound-wire coil springs.

It is possible to simultaneously use both methods of biasing the rotation members (40–40') to the straight-ahead orientation (i.e. using the extension springs illustrated in both FIGS. 10*a* and 10*b*).

Also, other types of springs can be used to bias the rotation members (40–40') to the "straight-ahead" orientation. For example, compression springs could be arranged either between rotation members (40–40') and the base platform (20), or between rotation members alone. Another option is the use of torsion springs to bias the rotation to a certain position (not illustrated).

Also, combinations of spring types and arrangements could be provided to bias the orientation of the rotation members.

Figure 11:
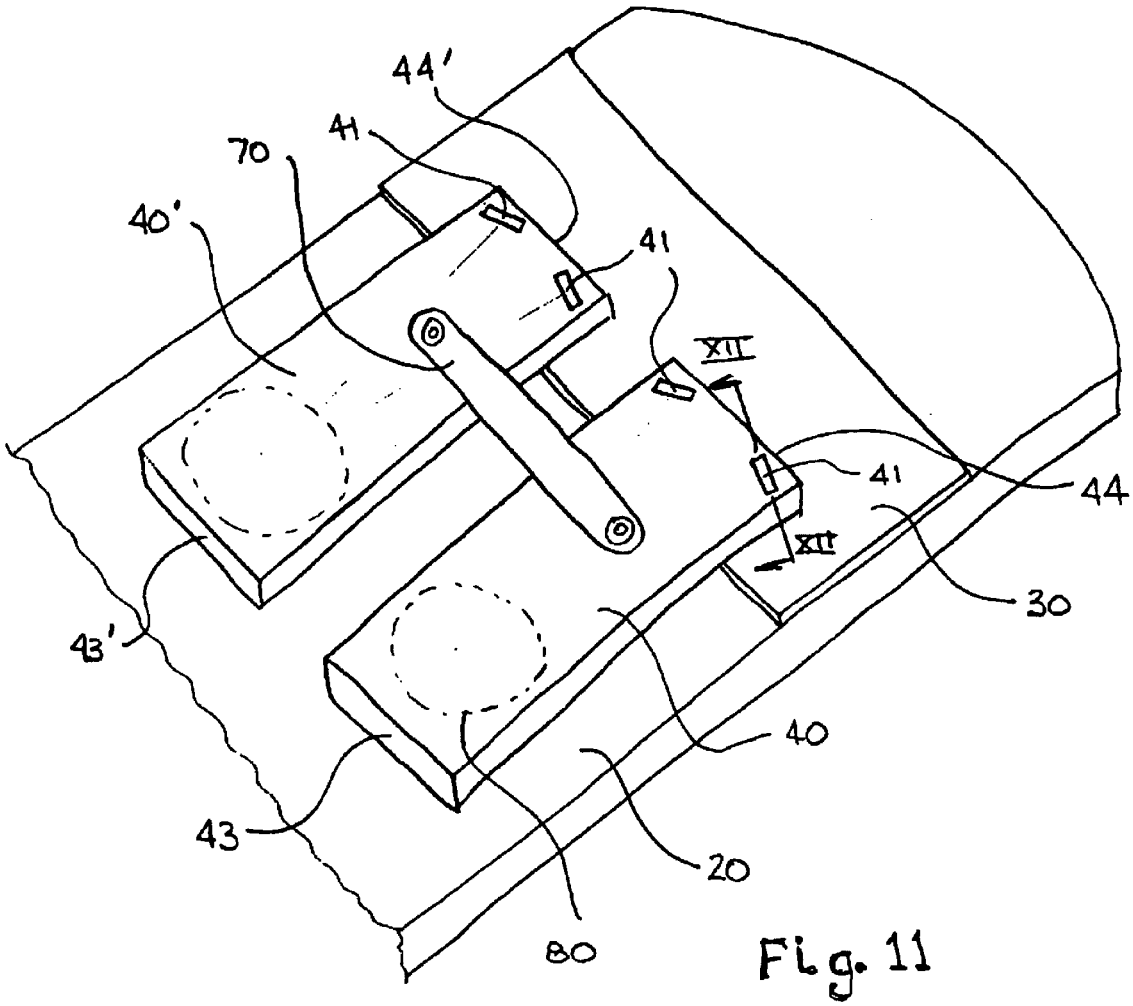
FIG. 11 is a perspective view of the parallel ski training device.

FIG. 11 is a perspective view of the parallel ski training device.

Depending on the amount of bending support afforded by the rotation axes of thrust bearings (80), it may be desirable to provide support toward rear edges (43–43') of rotation members (40–40').

Openings (41) in rotation members (40–40') can be used to contain axles and auxiliary support wheels. As shown in FIG. 11, a three-point support is provided for each rotation member. The three-point support can be made up of bearing (80), and one auxiliary support wheel in each of two openings (41).

Further, a wear material (30) can be provided if the base platform (20) material is soft or would be dented, abraded, or other wise worn.

Figure 12:
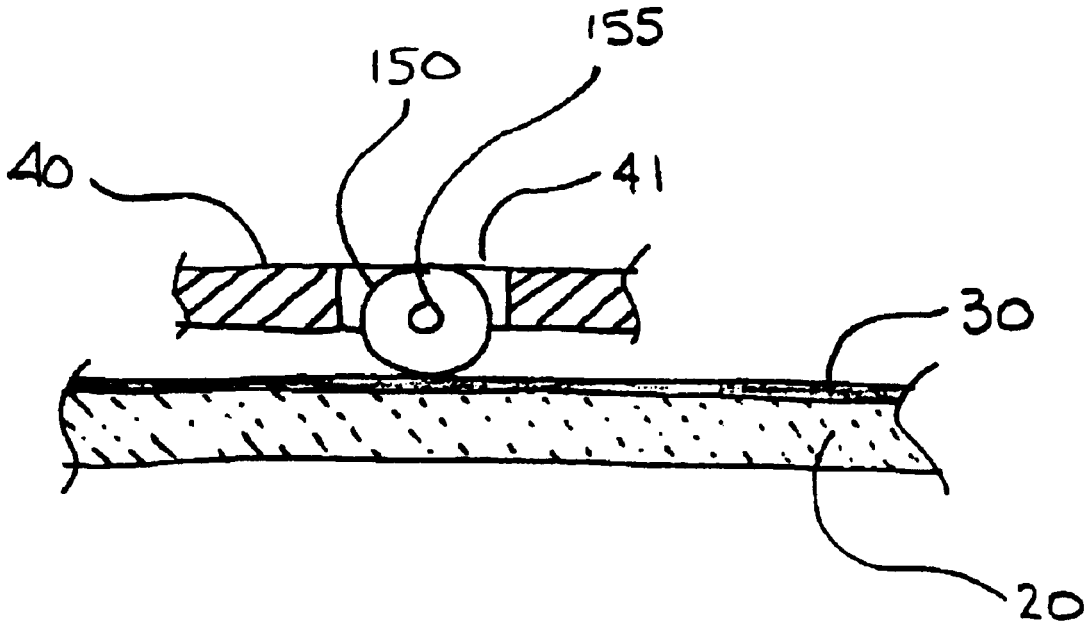
FIG. 12 is a partial sectional view taken in the direction of arrows "XII" in FIG. 11.

FIG. 12 is a partial sectional view taken in the direction of arrows "XII" in FIG. 11.

Cutouts (41) can be provided in rotation members (40), making room for auxiliary support wheels (150). Auxiliary support wheels (150) turning on axles (155) and bearing on wear surface (30) promote easy and free rotation of the rotation member (40).

Auxiliary support wheels (150) turn easiest when the longitudinal axes of axles (155) intersect the rotation axis of the thrust bearing (80) associated with the rotation member (40).

Figure 13:
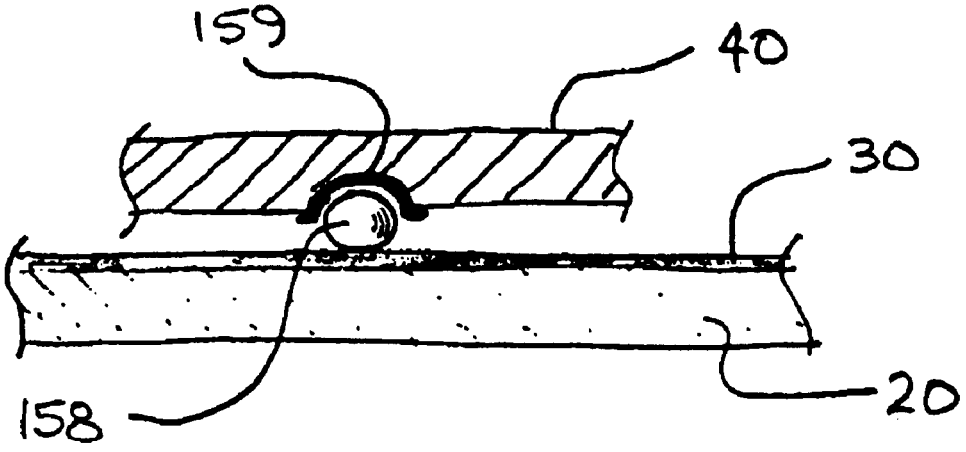
FIG. 13 is a hypothetical partial sectional view taken in the same direction as arrows "XII" in FIG. 11.

FIG. 13 is a hypothetical partial sectional view taken in the same direction as arrows "XII" in FIG. 11.

Alternative auxiliary support means are contemplated to be within the scope of the present invention. For example, steel spherical bearings (158) can be nested in plastic sockets (159), located approximately where cutouts (41) are illustrated in FIG. 11.

The present invention, described above, relates to a parallel ski training device. Features of the present invention are recited in the appended claims. The drawings contained herein necessarily depict structural features and embodiments of the parallel ski training device, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What I claim is:

1. An exercise apparatus comprising:

a base platform having a bottom surface and a flat top face, front and rear edges, left and right edges, and a longitudinal centerline equidistant from the left and right edges;

first and second rotation members having top faces and longitudinal axes and, where each rotation members is independently rotatably mounted to the top face of the base platform;

means to rigidly constrain the rotation of the rotation members so that their longitudinal axes always remain parallel; and first and second foot platforms tiltably mounted to the first and second rotation member top faces respectively, where the foot platform tilt axes and the rotation member longitudinal axis are parallel.

2. An exercise apparatus as described in claim 1, where the foot platform tilt axes are located between the rotation member top faces and the foot platforms.

3. An exercise apparatus as described in claim 1, further comprising means to bias the rotation members rotation angle to the position where the line connecting the two rotation axes is perpendicular to the rotation member longitudinal axes.

4. An exercise apparatus as described in claim 1, where the means to constrain the rotation of the rotation members comprises a tie bar having a longitudinal axis and where the tie bar is rotatably fastened to both rotation members.

5. An exercise apparatus as described in claim 4, further comprising means to bias each foot platform tilt angle to the position where the top face of the foot platform is parallel to the top face of the base platform.

6. An exercise apparatus as described in claim 1, where the base platform rear edge is curved; and further comprising:

a pedestal having a hemispherical or circular arc or semi-conical or semi-round shape; and where the pedestal is located on the base platform bottom surface, on the base platform longitudinal centerline, closer to the base platform front edge than to its rear edge, so that the front edge of the base platform is raised and the base platform is rockable from right to left.

7. An exercise apparatus as described in claim 1, wherein the bottom surface of the base platform is shaped so that the front edge of the base platform is raised and the base platform is rockable from right to left.

8. An exercise apparatus as described in claim 6, where the foot platform tilt axes are located between the rotation member top faces and the foot platforms.

9. An exercise apparatus as described in claim 6, further comprising means to bias the rotation members rotation angle to the position where the line connecting the two rotation axes is perpendicular to the rotation member longitudinal axes.

10. An exercise apparatus as described in claim 6, where the means to constrain the rotation of the rotation members comprises a tie bar having a longitudinal axis and where the tie bar is rotatably fastened to both rotation members.

11. An exercise apparatus as described in claim 10, further comprising means to bias each foot platform tilt angle to the position where the top face of the foot platform is parallel to the top face of the base platform.

12. An exercise apparatus as described in claim 2, further comprising compression springs interposed between the top faces of the rotation members and bottom faces of the foot platforms so as to bias each foot platform tilt angle to the position where the top face of the foot platform is parallel to the top face of the base platform.

13. An exercise apparatus as described in claim 3, where the means to bias the rotation angle comprises extension springs.

14. An exercise apparatus as described in claim 4, further comprising:

foot platform tilt axes, each comprising eyes fastened to the bottom face of a foot platform, eyes fastened to the top face of a rotation member, and a shaft passing through all of the eyes so that the longitudinal axes of the shafts are parallel with the longitudinal axes of the rotation members;

compression springs interposed between the top faces of the rotation members and bottom faces of the foot platforms so as to bias each foot platform tilt angle to the position where the top face of the foot platform is parallel to the top face of the base platform;

extension springs arranged to bias the rotation members rotation angle to the position where the line connecting the two rotation axes is perpendicular to the rotation member longitudinal axes; and a pedestal having a hemispherical or circular arc or semi-conical or semi-round shape, where the pedestal is located on the base platform bottom surface, on the base platform longitudinal centerline, closer to the base platform front edge than to its rear edge, so that the front edge of the base platform is raised and the base platform is rockable from right to left.

15. An exercise apparatus as described in claim 14, where the rotation member rotation axes are located proximately below the balls of the user's feet and further comprising:

rotation member support means located between the rotation member bottom faces and the base platform top face, and located proximately below the heels of the user's feet.

* * * * *